US005445907A

United States Patent [19]

Ito et al.

[11] Patent Number: 5,445,907

[45] Date of Patent: Aug. 29, 1995

[54] BATTERY TERMINAL

[75] Inventors: Hikaru Ito; Masakuni Kasugai, both of Yokkaichi, Japan

[73] Assignee: Sumitomo Wiring Systems, Ltd., Yokkaichi, Japan

[21] Appl. No.: 193,414

[22] Filed: Feb. 7, 1994

[30] Foreign Application Priority Data

Mar. 9, 1993 [JP] Japan ..... 5-009836 U

[51] Int. Cl.[6] ..... H01M 2/30

[52] U.S. Cl. ..... 429/178; 429/179; 439/765; 439/770

[58] Field of Search ..... 429/178, 179; 439/762, 439/770, 765, 768, 774

[56] References Cited

U.S. PATENT DOCUMENTS 1,665,048 4/1928 Weimer et al. ..... 439/770
5,290,646 3/1994 Asao et al. .
5,302,142 4/1994 Tabata .
5,302,143 4/1994 Inoue et al. .

FOREIGN PATENT DOCUMENTS 4-9736 3/1992 Japan .

*Primary Examiner*—Anthony Skapars
*Attorney, Agent, or Firm*—Sandler, Greenblum & Bernstein

[57] ABSTRACT

Notches are provided on the inside circumference surface of the annular post fittings of a battery terminal fit over a battery post. The sharp tips of these notches bite into the outside circumference surface of the battery post to prevent the battery terminal from rotating on the post.

14 Claims, 4 Drawing Sheets

BATTERY TERMINAL

BACKGROUND OF THE INVENTION

1. Field of the Invention

The present invention relates to a battery terminal connected to the electrode (battery post) of a battery installed in a motor vehicle, and particularly to a battery terminal installed by means of tightening a bolt in a clamping member from vertically above.

2. Description of the Prior Art

With a conventional battery terminal of this type, an annular post fitting is fit over the battery post protruding from the battery. The base members contiguous to the free ends of the post fitting are then clamped tight to the post via a bolt and nut tightened from the side using an impact wrench or other power tightening tool.

In most late-model passenger vehicles, however, the engine compartment is extremely crowded as a growing number of components are installed in a confined space. This makes it difficult to adequately tighten the post fitting by applying a horizontal force because of interference from other engine compartment components with the tightening tools. It is even possible for the impact wrench to contact the negative terminal while tightening the positive post fitting, causing an electrical short which, in a worst-case scenario, could cause an engine compartment fire.

The battery terminal shown in FIGS. 5*a* and 5*b* has therefore been proposed (Utility Model Publication (examined) 4-9736) as a means of solving this problem. With this battery terminal, opposing base 3*b* and tightening members 3*c* forming a taper that is wider at the bottom than the top are formed as part of the terminal body 3. A clamping member 5, forming a similar taper that is wider at the bottom than the top, fits over and is then pulled down over the base 3*b* and tightening members 3*c* by tightening a bolt 4. This causes the post fitting 3*a* to close and clamp the post 2 of the battery 1.

The problem with this configuration, however, is that on the automobile assembly line many bolts are tightened as the assembly line keeps moving, and the torque of the impact wrench is not readjusted for each tightening task. As a result, bolt tightening using an impact wrench is dependent upon the experience of the operator and visual inspection of bolt tightness.

Torque control is also not generally used when tightening the battery terminal bolts. As a result, the terminal bolt may be overtightened due to continued tightening after the post fitting is sufficiently clamped to the battery post.

With the battery terminal described above, excessive tightening force can cause the battery terminal to turn in the direction of arrow X in FIG. 5*a* around the battery post 2. This can result in damage to the wires connected to the battery terminal.

SUMMARY OF THE INVENTION

Therefore, an object of the present invention is to provide a battery terminal which when tightened to the battery post by means of a bolt using an impact wrench of which the torque is unregulated will not turn on the battery post even when additional torque is applied by the impact wrench after the battery terminal is tightened sufficiently to the battery post.

To achieve this object, a battery terminal for tightly clamping a battery annular post, according to the present invention comprises: a fold element having top and bottom ring-shaped post fitting members, said ring-shaped post fitting members formed with annular post fitting opening which is opened towards the folded end for defining two folded arms, said two folded arms having tapered walls; a clamping member having tapered sides; an urging means for urging said two folded arms into said clamping member for sliding said tapered walls along said tapered sides to close said two folded arms; and notches having pointed tips projecting from the inside circumference surface of at least one of said ring-shaped post fitting members for biting into the outside circumference surface of the battery post.

The urging means is formed by a nut held in a space between said two folded arms and a bolt engaged to the clamping member and threaded to said nut for sliding said tapered walls along said tapered sides to close said two folded arms.

Note that the notches formed on the inside circumference surface of the post fitting may be formed as a series of teeth that are wave-shaped in cross section and continuous in the circumferential direction. Said notches may also be formed discontinuously spaced in the circumferential direction.

When the bolt is tightened using an impact wrench or other power tightening tool with a battery terminal thus described, the tips of the notches bite into the outside circumference surface of the battery post to prevent rotation of the battery terminal. As a result, when excessive torque is applied using an impact wrench for which the torque output is not specifically controlled, the battery terminal will not turn on the battery post.

In addition, because the tips of the notches bite into the battery post, positive contact between the battery post and battery terminal can be assured, and poor electrical contact does not occur.

Furthermore, even when the tightening force holding the battery terminal to the battery post is weak, sufficient electrical contact can be obtained by means of the notches.

BRIEF DESCRIPTION OF THE DRAWINGS

The present invention will become more fully understood from the detailed description given below and the accompanying diagrams wherein.

DESCRIPTION OF A PREFERRED EMBODIMENT

The preferred embodiment of a battery terminal according to the present invention is described below with reference to the accompanying figures.

Figure 1:
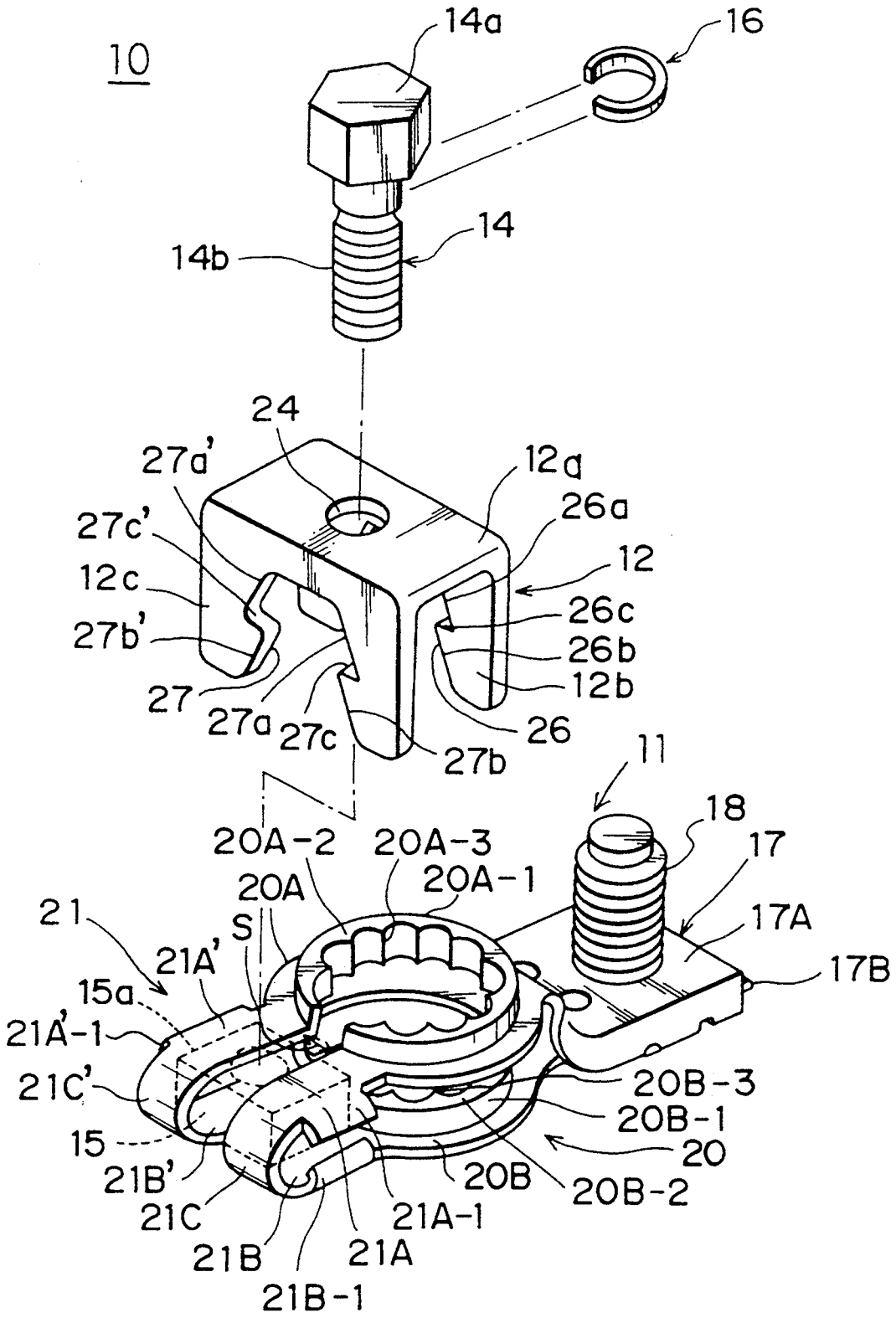
FIG. 1 is an exploded view of a battery terminal according to the present invention.

As shown in FIG. 1, the battery terminal 10 of the present invention comprises terminal body 11, clamping member 12, bolt 14, nut 15, and ring 16.

The terminal body 11 is a stud bolt type terminal, and is manufactured by shaping and bending a single metal piece in two as shown in the figure. A stud bolt 18 is provided in the wire connector 17 at one end of the battery terminal. The terminal (not shown in the figures) crimped to an electrical wire is placed over and clamped to the stud bolt 18 using a nut (not shown in the figures).

Note that the terminal body 11 may alternatively be a crimped-barrel terminal whereby a barrel integrally formed to the electrical wire connector is crimped to secure and connect the electrical wire to the terminal.

The terminal body 11 forms the wire connector 17, post fitting 20, and clamping end 21 by bending top and bottom parts, which are basically identical in shape, around a bending member at one end such that the top part vertically opposes the bottom part.

More specifically, both top and bottom parts have at one end a rectangularly shaped wire connector 17A or 17B, each being connected to a ring-shaped post fitting 20A or 20B, respectively. A cylindrical member 20A-1 or 20B-1 stands around the inside circumference edge of the post fittings 20A, 20B.

Notches 20A-2, 20B-2 having a wave-shaped cross section are formed continuously around the inside circumference surfaces of the cylindrical members 20A-1, 20B-1, The tips 20A-3, 20B-3 of the projecting ends of each of the notches 20A-2, 20B-2 project in an acute point to the inside of the post fittings 20A and 20B.

The end opposite the electrical wire connector side of the post fittings 20A, 20B is open as shown in FIG. 1. Clamping ends 21A, 21A', 21B, and 21B' are provided contiguous to each free end. The right side clamping ends 21A and 21B and the left side clamping ends 21A' and 21B' are respectively linked by bending members 21C and 21C', respectively. The right and left clamping ends 21A, 21B and 21A', 21B' are separated by a space S.

Slide members 21A-1 and 21A'-1 sloping down to the outside are provided at the outside edges of the top clamping ends 21A, 21A'. Slide members 21B-1 and (21B'-1 not shown in the figures) sloping up to the inside are provided at the outside edges of the bottom clamping ends 21B, 21B'.

The clamping member 12 is a C-shaped member comprising a top 12*a* and two sides 12*b* and 12*c*. A bolt hole 24 is provided at the center of the top 12*a*.

As shown in the figures, side walls 26, 27 that are open to the bottom are provided in the middle of the sides 12*b*, 12*c*, which extend perpendicularly from the edges of the top 12*a*. Taper faces 26*a*, 26*b*, 26*a'*, 26*b'*, 27*a*, 27*b*, 27*a'*, and 27*b'* forming tapered members widening to the bottom are provided in horizontal opposition in two vertical stages on the right and left side edges of the side walls 26, 27. The horizontal faces connecting the taper faces 26*a* . . . 27*b'* are the shoulders 26*c*, 26*c'*, 27*c*, and 27*c'*.

Figure 3A:
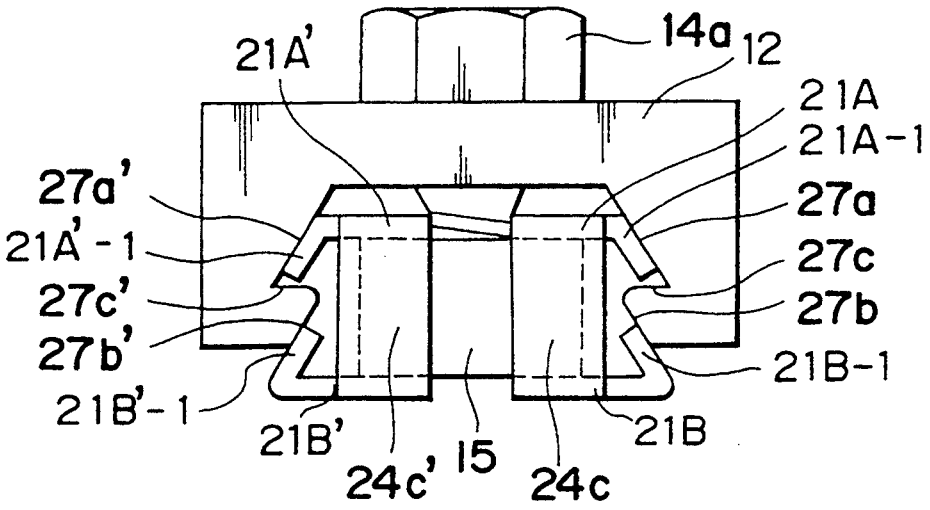
FIGS. 3*a* and 3*b* are diagrams showing the closing operation of side walls as the bolt is tightened.

As shown in FIG. 3*a*, the clamping member 12 is assembled to the battery terminal with the taper faces 26*a* . . . 27*b'* contacting and sliding freely along the slide members 21A-1 . . . 21B'-1 of the clamping end 21. A nut 15 is housed in the space defined by the clamping ends 21A, 21A', 21B, 21B' and bending members 21C and 21C' in the clamping end 21, and a bolt 14 is threaded partially into the nut 15 through the bolt hole 24 of the clamping member 12.

Note that a ring 16 (not shown in FIGS. 3*a* and 3*b*, but only shown in FIG. 1) is fitted to the top of the shank 14*b* of the bolt 14. This ring 16 causes the clamping member 12 to rise as the bolt 14 is loosened.

With the bolt 14 loosely threaded into the nut 15, a space S remains between the clamping ends 21A, 21A' and 21B, 21B' on both sides, and the free-end sides of the post fittings 20A, 20B contiguous to the clamping ends 21A . . . 21B' are fully open.

The battery terminal 10 is mounted to the battery post 2 by fitting the post fittings 20A, 20B over the post. The post fittings 20A, 20B can be easily fit over the battery post because the free ends of the fittings are open wide.

Figure 2A:
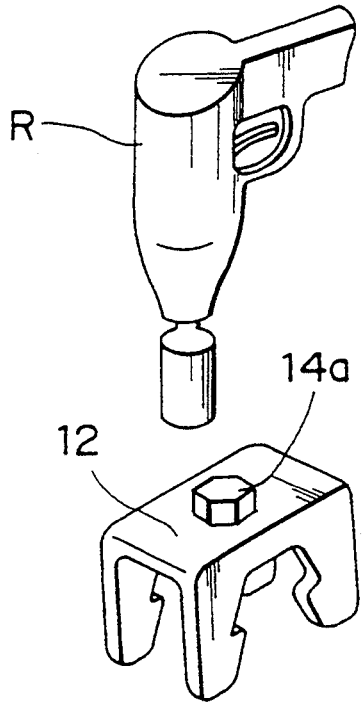
FIGS. 2*a* and 2*b* are diagrams showing the bolt tightening operation using appropriate tools.
Figure 2B:
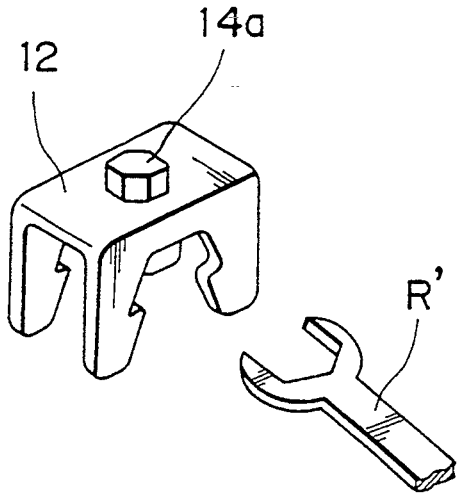

The head 14*a* of the bolt 14 is then turned and tightened into the nut 15 using a power tightening tool such as an impact wrench R (FIG. 2*a*) or manually using an open-end wrench R' (FIG. 2*b*) or other wrench.

Figure 3B:
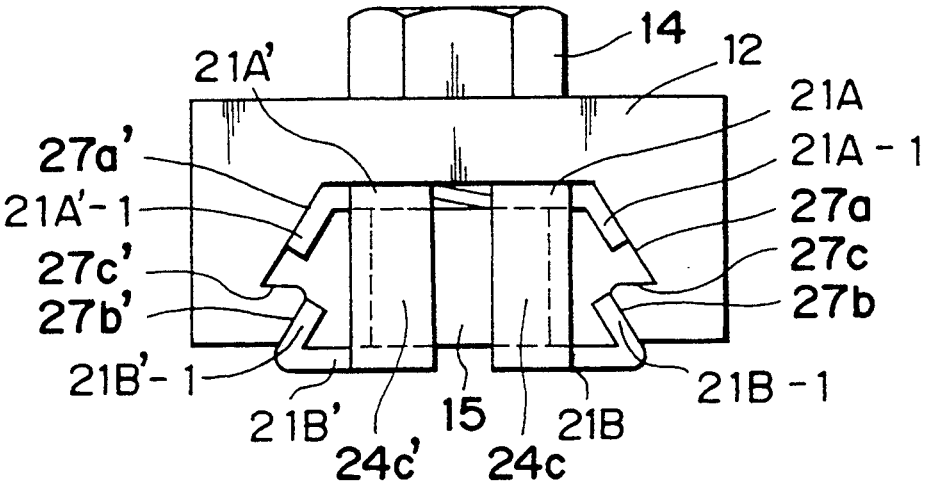
Figure 5A:
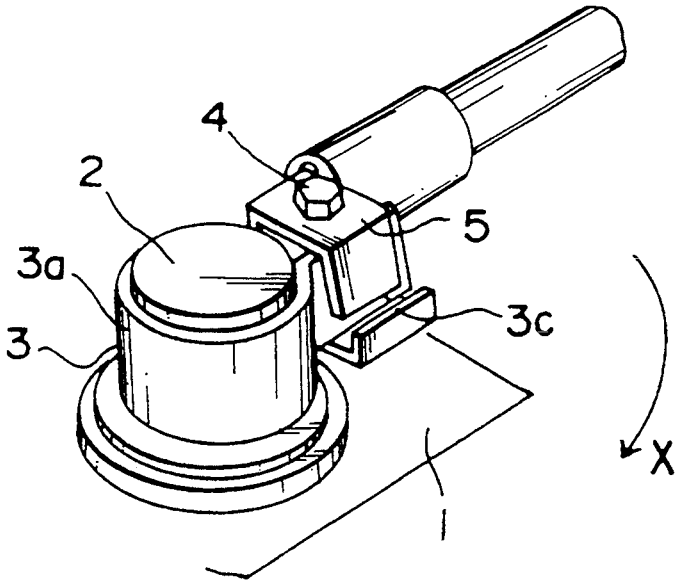
Fig. 5a PRIOR ART
FIGS. 5*a* and 5*b* are diagrams showing an example of the prior art.
Figure 5B:
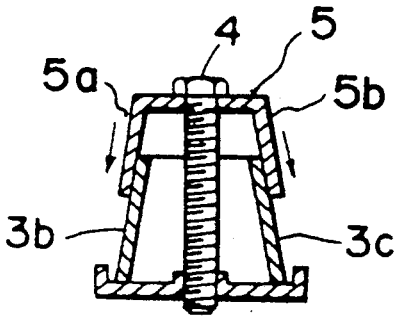
Fig. 5b PRIOR ART

As shown in FIG. 3*b*, as the bolt 14 is tightened downward, the clamping member 12 also moves down and the taper faces 26*a* . . . 27*b'* of the side walls 26, 27 press the slide members 21A-1 . . . 21B'-1 projecting to the outside from the right and left clamping ends 21A . . . 21B' horizontally to the inside. As a result, the right and left clamping ends 21A . . . 21B' move horizontally closer together, and the free ends of the post fittings 20A, 20B contiguous to the right and left clamping ends 21A . . . 21B' close.

As the free ends of the post fittings 20A, 20B close, the inside diameter of the center opening becomes smaller, and the inside circumference surfaces of the post fittings 20A, 20B approach the outside circumference surface of the post 2.

Figure 4:
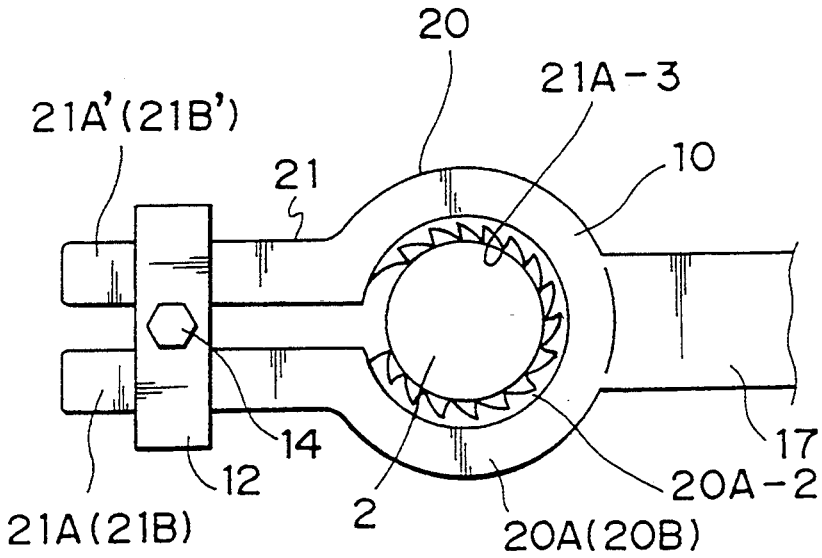
FIG. 4 is a simplified top plan view showing the battery terminal clamped to the battery post.

This causes the tips 20A-3, 20B-3 projecting at an acute angle from the notches 20A-2, 20B-2 on the inside circumference surface of the post fittings 20A, 20B to press against the outside circumference surface of the post 2. As the post fitting is further tightened by the bolt, the tips 20A-3, 20B-3 bite into the outside circumference surface of the post 2 as shown in FIG. 4.

When the tips 20A-3, 20B-3 of the notches 20A-2, 20B-2 on the inside circumference surface of the post fittings 20A, 20B bite into the outside circumference surface of the post 2, rotation of the battery terminal 10 is effectively stopped. As a result, the battery terminal 10 will not turn on the battery post even when the bolt 14 is overtightened, and the battery terminal 10 is effectively held clamped to the battery post.

As will be obvious from the above description, once a battery terminal according to the present invention is firmly clamped to the battery post by tightening a bolt using an impact wrench or other tightening tool, the post fitting of the battery terminal is clamped in a manner preventing the post fitting from turning on the battery post.

As a result, when an impact wrench of which the torque is not controlled is used on the assembly line to clamp the battery terminal to the battery post and excessive tightening force is applied thereby, the battery terminal is prevented from turning on the battery post.

A reliable electrical connection between the battery terminal and battery post can also be assured with a battery terminal according to the present invention because the battery terminal is clamped to the battery post with the tips of the notches of the post fitting biting into the outside circumference surface of the battery post.

Even when the bolt tightening force is weak, sufficient electrical contact can be assured because of the projecting tips of the notches provided on the inside circumference surface of the post fitting.

The productivity of the battery terminal installation task can thus be improved because special attention is not required to prevent overtightening of the bolt or contact problems caused by insufficient bolt tightening.

The battery terminal of the invention also helps prevent damage to components resulting from inexperience tightening the battery terminal.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A battery terminal for tightly clamping a battery post, said battery post having an outer circumferential surface, said battery terminal comprising:

a folded element having top and bottom ring-shaped post fitting members, said ring-shaped post fitting members formed with a post fitting opening and each of said ring-shaped members having an inner circumferential surface, and a gap for defining two folded arms, said two folded arms having an angled portion extending at an angle with respect to an angled portion on the other folded arm;

a clamping member having tapered sides;

urging means for urging said two folded arms into said clamping member for sliding said angled portions along said tapered sides to close said two folded arms; and notches having pointed tips projecting from the inner circumferential surface of at least one of said ring-shaped post fitting members for biting into the outer circumferential surface of the battery post.

2. A battery terminal for tightly clamping a battery post, said battery post having an outer circumferential surface, said battery terminal comprising:

a folded element having top and bottom ring-shaped post fitting members, said ring-shaped post fitting members formed with a post fitting opening and each of said ring-shaped members having an inner circumferential surface, and a gap for defining two folded arms, said two folded arms having walls generally angled with respect to a wall on the other folded arm;

a nut held in a space between said two folded arms;

a clamping member having tapered sides;

a bolt engaged to said clamping member and threaded to said nut for sliding said angled walls along said tapered sides to close said two folded arms; and notches having pointed tips projecting from the inner circumferential surface of at least one of said ring-shaped post fitting members for biting into the outer circumferential surface of the battery post.

3. A battery terminal according to claim 2, wherein said notches are formed as a series of projections that are wave-shaped in cross section and continuous in the circumferential direction.

4. The battery terminal of claim 1 wherein said folded arms further comprise a top arm and a bottom arm and said angled wall portions are provided on the outside edges of the top arm.

5. The battery terminal of claim 4 wherein said angled wall portions slope down and away from each other.

6. The battery terminal of claim 1 wherein said folded arms further comprise a top arm and a bottom arm and said angled wall portions are provided on the outside edges of the bottom arm.

7. The battery terminal of claim 6 wherein said angled wall portions slope up and toward each other.

8. The battery terminal of claim 1 wherein said folded arms further comprise a top arm and a bottom and said angled wall portions are provided on the outside edges of said top and bottom arms, and are formed by bending said outside edges.

9. The battery terminal of claim 2 wherein said folded arms further comprise a top arm and a bottom arm and said angled walls are provided on the outside edges of the top arm.

10. The battery terminal of claim 9 wherein said angled walls slope down and away from each other.

11. The battery terminal of claim 2 wherein said folded arms further comprise a top arm and a bottom arm and said angled walls are provided on the outside edges of the bottom arm.

12. The battery terminal of claim 11 wherein said angled walls slope lap and toward each other.

13. The battery terminal of claim 2 wherein said folded arms further comprise a top arm and a bottom and said angled walls are provided on the outside edges of said top and bottom arms, and are formed by bending said outside edges.

14. A battery terminal according to claim 1, wherein said notches are formed as a series of projections that are wave-shaped in cross section and continuous in the circumferential direction.

* * * * *

UNITED STATES PATENT AND TRADEMARK OFFICE

CERTIFICATE OF CORRECTION

PATENT NO. : 5,445,907

DATED : August 29, 1995

INVENTOR(S) : H. ITO et al.

It is certified that error appears in the above-indentified patent and that said Letters Patent is hereby corrected as shown below:

At column 6, line 37, (claim 12, line 2), change "lap" to —up—.

Signed and Sealed this

Fifteenth Day of October, 1996

Bruce Lehman

*Attest:*

BRUCE LEHMAN

*Attesting Officer*

*Commissioner of Patents and Trademarks*